US006357360B1

(12) United States Patent
Arnswald et al.

(10) Patent No.: US 6,357,360 B1
(45) Date of Patent: Mar. 19, 2002

(54) FRAME BRACE AND CENTER CLAMP

(75) Inventors: Daniel G. Arnswald, Chicago; Thomas J. Heyden, Arlington Heights; Curtis W. Hoover, Tinley Park, all of IL (US)

(73) Assignee: Standard Car Truck Company, Park Ridge, IL (US)

( * ) Notice: Subject to any disclaimer, the term of this patent is extended or adjusted under 35 U.S.C. 154(b) by 0 days.

(21) Appl. No.: 09/431,108

(22) Filed: Nov. 1, 1999

(51) Int. Cl.[7] ..... B61F 5/00

(52) U.S. Cl. ..... 105/182.1

(58) Field of Search ..... 105/157.1, 165, 105/167, 182.1, 206.1

(56) References Cited

U.S. PATENT DOCUMENTS 5,461,986 A * 10/1995 Sarnicki et al. ..... 105/165
5,584,250 A * 12/1996 Berg ..... 105/182.1

* cited by examiner

*Primary Examiner*—Mark T. Le
(74) *Attorney, Agent, or Firm*—Cook, Alex, McFarron, Manzo, Cummings & Mehler, Ltd.

(57) ABSTRACT

A rail car truck includes a pair of longitudinally spaced wheelsets, a pair of laterally spaced side frames extending between and supported by the wheelsets and a bolster which extends between the side frames to support a vehicle body. There is a brace connected between the side frames to control relative longitudinal movement therebetween. The brace includes a center clamp assembly located generally intermediate the side frames and generally mid-way between the wheelsets. Each side frame mounts a pair of longitudinally spaced end blocks. There are four struts, each being inclined to the longitudinal axis of the truck and each extending from and being connected to an end block and to the clamp assembly.

13 Claims, 4 Drawing Sheets

Fig. 1.
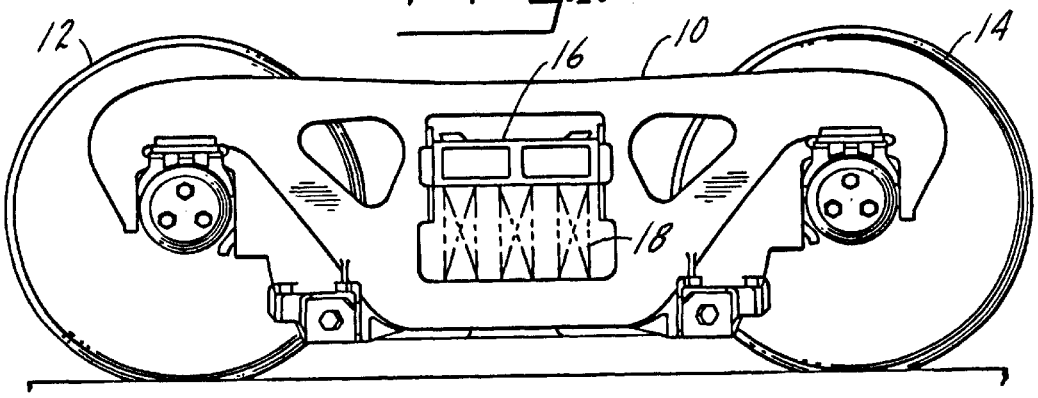
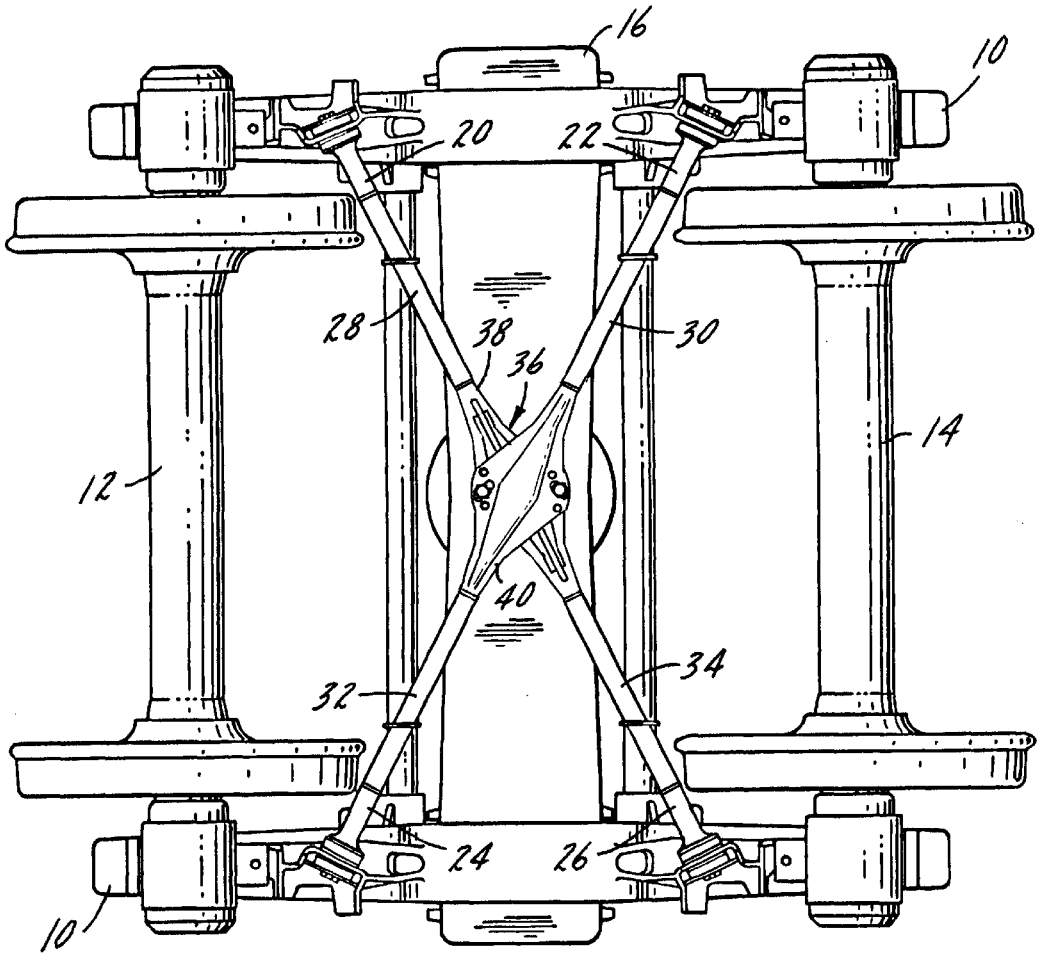
Fig. 2.

Fig. 13.
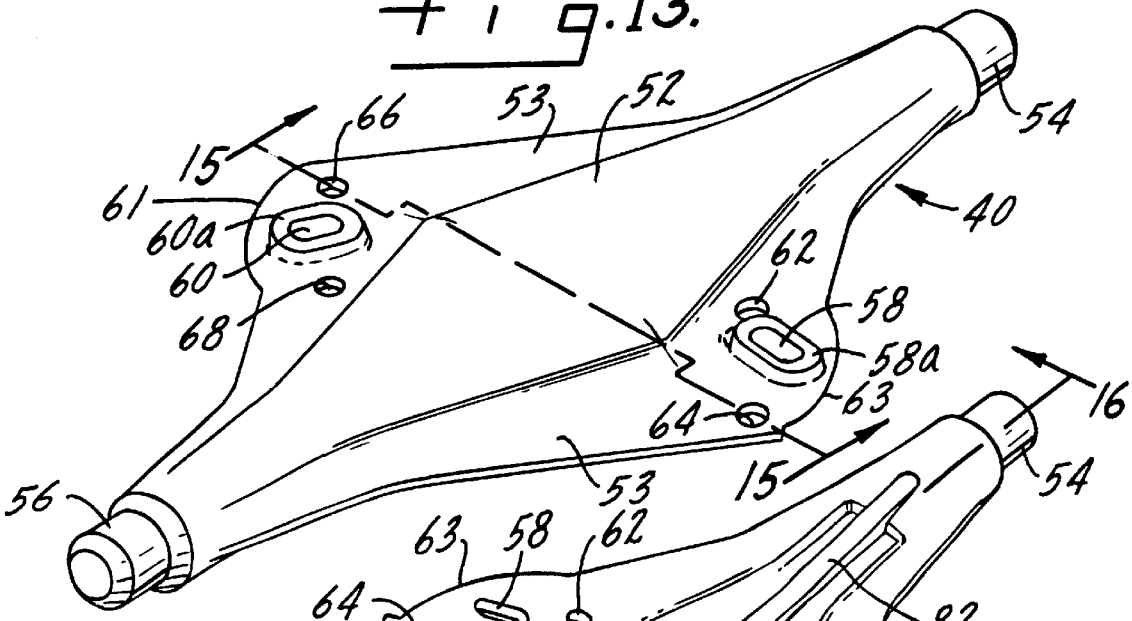
Fig. 14.
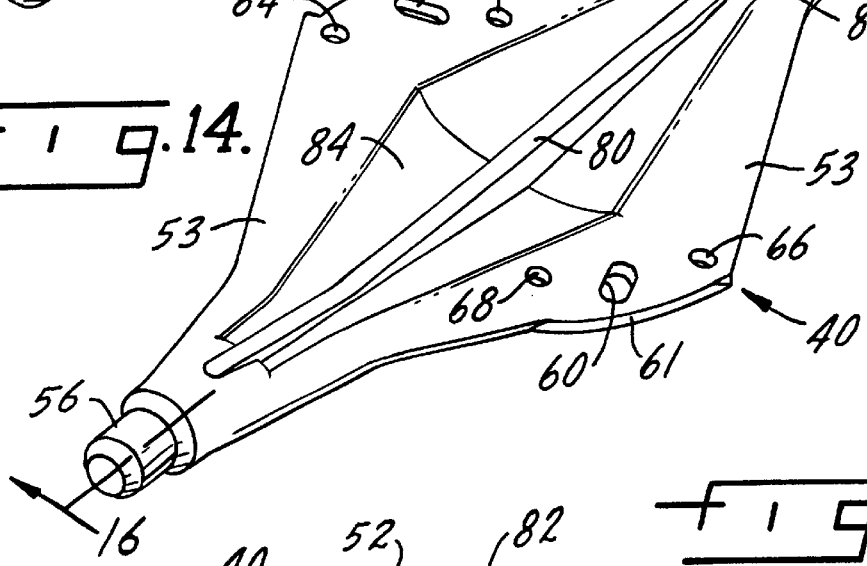
Fig. 15.
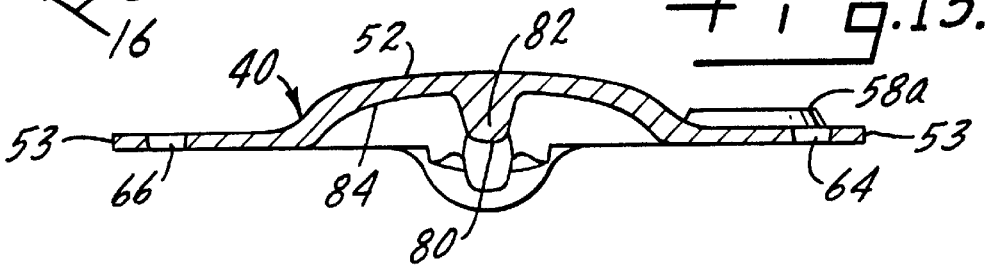
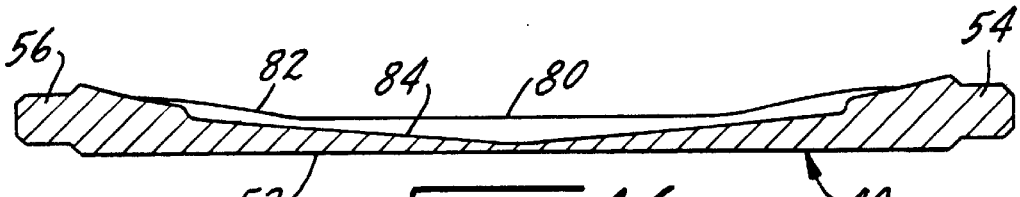
Fig. 16.

FRAME BRACE AND CENTER CLAMP

FIELD OF THE INVENTION

The present invention relates to frame brace rail car trucks of the type described in U.S. Pat. Nos. 4,570,544; 5,243,920; 5,584,250, all assigned to the assignee of the present application, Standard Research and Design Corporation of Park Ridge, Ill. In the 544' patent, the diagonal braces or struts which interconnect the side frames are held together at their intersection by a shackle 66. In the 920' patent, the struts are interconnected where they cross by a clamp plate assembly consisting of two clamp plates, each with a channel, and an elastomeric pad between the facing surface of the clamp plates and the struts. There are fasteners which hold the clamp plates together. In the 250' patent the clamp plates are welded to the frame brace struts and the clamp plates are welded to one another.

In the present invention there is a center clamp plate assembly and there are end blocks which are mounted in spaced relation to each other on each side frame. There are four struts, each extending between an end block and the clamp plate assembly, with each of the struts being mounted on trunnions extending outwardly from an end block and from the clamp plate assembly. This construction provides substantial economies and efficiency in the manufacture and installation of the frame brace assembly and further provides a product with substantially increased fatigue endurance.

SUMMARY OF THE INVENTION

The present invention relates to frame brace rail car trucks in which a pair of cross struts are used to stabilize the truck and improve the resistance to relative longitudinal movement between the side frames, and more particularly to such a frame brace rail car truck in which the struts are each separately connected between the center clamp assembly and an end block.

The primary purpose of the invention is to provide an improved and substantially strengthened frame brace truck.

Another purpose is to provide a frame brace truck in which each of the struts extend from an end block mounted on the side frame and a center clamp assembly and are welded to each of those elements.

Another purpose of the invention is to provide a center clamp assembly including a pair of identical plates which may be cast or forged to eliminate stress concentrations found in previous center clamp assemblies.

Another purpose of the invention is to provide a center clamp assembly for the use described with the center clamp plates having a reduced thickness which allows for a reduction in the vertical distance between the mounting of the center clamp assembly and the mounting point of the struts to the side frames.

Another purpose of the invention is to provide a center clamp plate for the use described in which the plates have radiused flanges allowing the angle between struts to be altered which provides for increased ease in designing non AAR standard rail car trucks.

Another purpose is a frame brace truck as described in which the use of trunnions on the center clamp assembly and the end blocks allows for ease and adjustment of strut length during manufacture.

Another purpose is to provide a strut for use in a frame brace truck as described which has a constant diameter, eliminating tube plastic deformation necessary in prior art constructions.

Other purposes will appear in the ensuing specification, drawings and claims.

DESCRIPTION OF THE DRAWINGS

The invention is illustrated diagrammatically in the following drawings wherein:

FIG. 1 is a side view of a rail car truck of the type disclosed herein;

FIG. 2 is a bottom view of the rail car truck of FIG. 1;

FIG. 13 is a top perspective of a center clamp plate;

FIG. 14 is a bottom perspective of a center clamp plate;

FIG. 15 is a section along plane 15—15 of FIG. 13; and

FIG. 16 is a section along plane 16—16 of FIG. 14.

DESCRIPTION OF THE PREFERRED EMBODIMENT

Figures 3, 4, 5, 6:
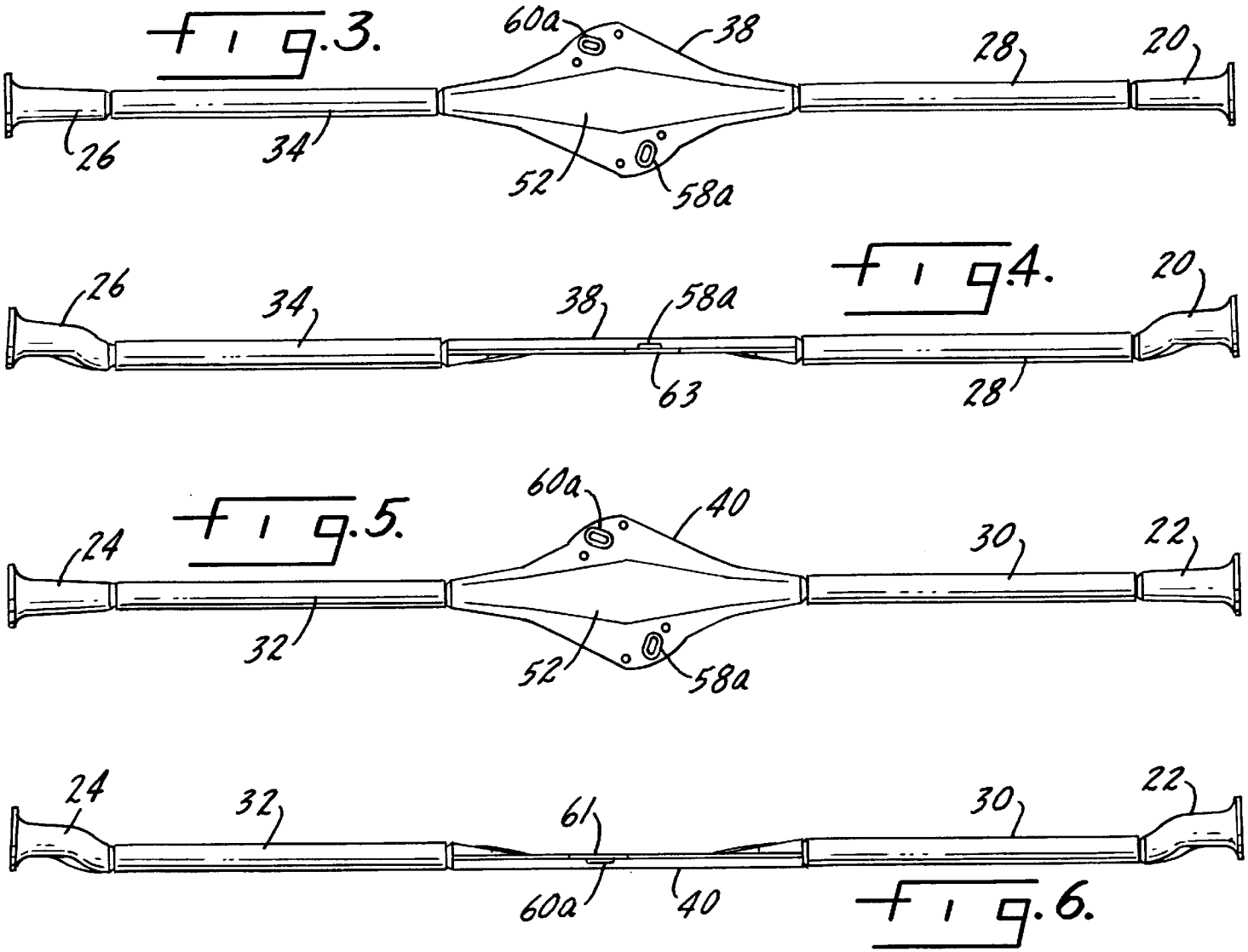
FIG. 3 is a top view, showing the exposed side of a clamp plate and the connections between the clamp plate, the associated struts and the end blocks mounted to the side frames.
FIG. 4 is a side view of the assembly of FIG. 3.
FIG. 5 is a bottom view showing the exposed side of a clamp plate and the connections between the clamp plate, the associated struts and the end blocks mounted to the side frames.
FIG. 6 is a side view of the assembly of FIG. 5.
Figure 7:
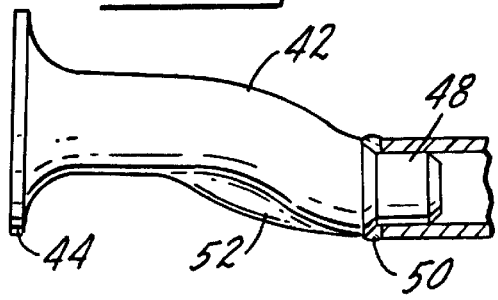
FIG. 7 is an enlarged side view, in part section, illustrating the connection between an end block and a strut.
Figure 8:
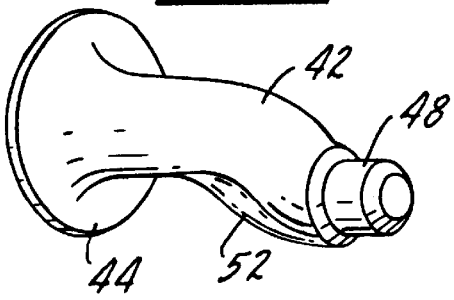
FIG. 8 is a perspective of an end block.
Figure 9:
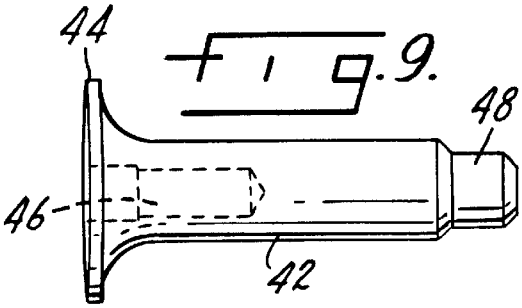
FIG. 9 is a top view of an end block.
Figure 10:
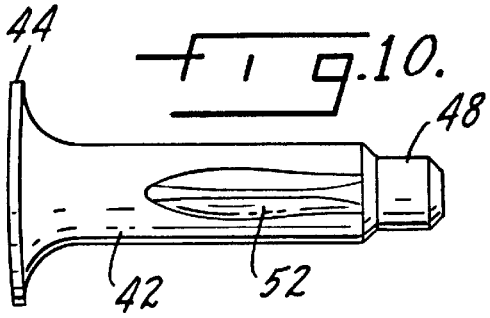
FIG. 10 is a bottom view of an end block.

U.S. Pat. No. 4,540,544 discloses a railroad car having a pair of side frames supported on conventional longitudinally spaced wheelsets. To improve truck stability, cross struts extend between the side frames to increase the resistance to side frame relative longitudinal movement. Elastomeric members may be placed between the wheelsets and the side frames to decrease the yaw stiffness of the wheelsets. As a result, the yaw stiffness and lateral stiffness of the truck can be selected to provide optimum truck stability.

U.S. Pat. No. 5,243,920 discloses an improvement of the 544' truck, specifically in the area of the clamp that holds the cross struts together at a location generally at the mid-point between the side frames. The 250' patent was an improvement on the clamp assembly of the '920 patent in that it strengthened the connection between the cross struts and eliminated the elastomeric member of the '920 patent. The present invention provides yet a further improvement in what is known as a frame brace truck by providing an improved center clamp assembly, and by dividing the cross struts into four individual struts, each of which extend between the center clamp assembly and the end blocks mounted on the side frames. This design provides enhanced fatigue endurance and greater ease of manufacturing than the prior art designs.

The center plate assembly consists of two identical plate members each of which may be cast or forged which allows for the smooth blending of surfaces which in turn results in the elimination of many stress concentrations present in prior art center clamp assemblies. Further, each of the center clamp plates has trunnions at its opposite ends which mount one end of the tubes which form the braces or struts, with the other end of the strut being mounted on a trunnion forming a part of the end block. Such a tube has no deformation which allows for increased strength in the tube and also eliminates the plastic deformation step necessary to install the previous cross struts in the center clamp. Further, the casting or forging of the center clamp parts allows the center clamp assembly to be reduced in thickness which results in an enhanced ability to place this part between the truck bolster and other portions of the truck assembly. The reduced thickness further allows for a reduction in the vertical distance between the mounting point of the braces on the side frame and the center clamp assembly. This in turn reduces eccentricity in the cross brace assembly providing reduced stress and enhanced performance.

In the drawings, conventional side frames are indicated at 10 and are mounted on wheelsets 12 and 14. Conventional roller bearings mount the wheelsets and the side frames are connected by a bolster 16. The bolster is supported on the side frames by springs 18 as is conventional.

The cross brace assembly consists of four end blocks indicated at 20, 22, 24 and 26 in FIG. 2, one of which is illustrated in detail in FIGS. 7–10. The end blocks are each secured to a side frame. Each of the end blocks mounts a strut or tube 28, 30, 32 and 34, with the tubes being of a length to bridge the distance between an end block and the center plate assembly 36. All of this structure is illustrated in FIGS. 1 and 2. In prior art frame brace assemblies, each strut extended between end blocks of opposing side frames and the struts, where they crossed, were secured and supported by a center clamp assembly. In the present invention the center clamp assembly joins the four individual struts, each of which are connected at their outboard ends to an end block.

FIGS. 3 and 4 show end blocks 20 and 26, struts 28 and 34 and a plate 38 which is one of the two identical plates forming the center plate clamp assembly 36. FIG. 3 shows a view looking from the exposed side of the plate 38 and FIG. 4 is a side view of this assembly.

Figure 11:
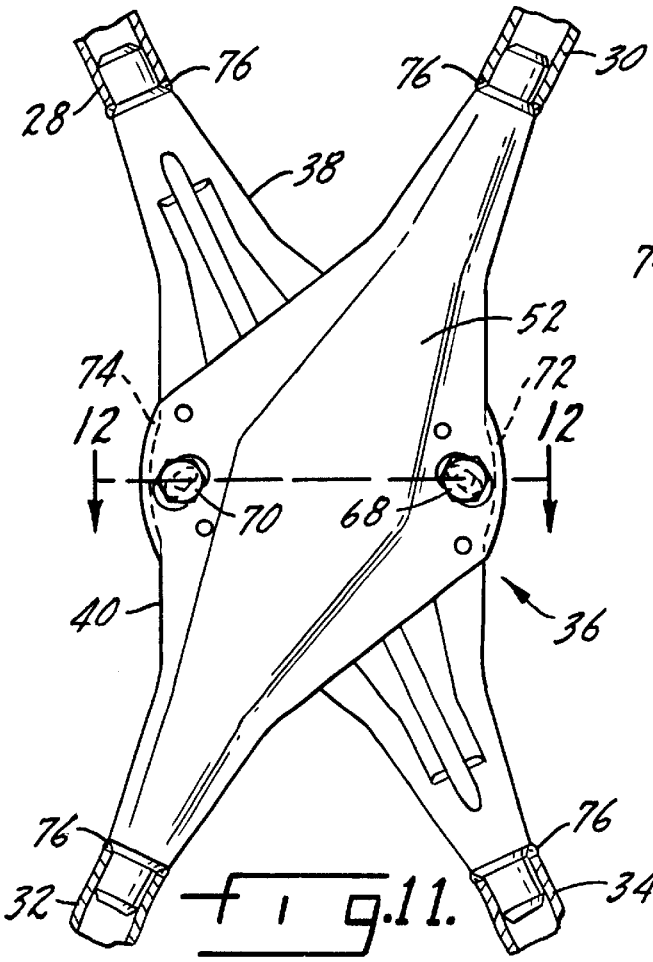
FIG. 11 is an enlarged bottom view of the center clamp plate assembly.

FIGS. 5 and 6 show end blocks 22 and 24, struts 30 and 32 and a center plate 40 which again forms a part of the center clamp plate assembly 36. FIG. 5 shows a view looking from the exposed side of a plate as illustrated in FIG. 2 and FIG. 11 with FIG. 6 being a side view of the assembly in FIG. 5.

FIGS. 7–10 illustrate an end block which includes a body 42 having a mounting flange 44 for attachment to a side frame. There is a bore 46 which may be used as a bolt hole for mounting the end block to the side frame. The end block is slightly down turned as shown particularly in FIG. 7 and has a trunnion 48 extending out from its inboard end. The trunnion 48 will mount one of the struts 28–34 and there will be a weld 50 at this joint to secure the end block to the strut. The bottom of the end block, as at 52, may have a downwardly extending rib which provides added strength to the end block structure.

The center clamp plates 38 and 40 are identical and the exposed side of a plate is illustrated in FIG. 13 and the facing side is illustrated in FIG. 14. The plates, combined to form the center clamp assembly, are shown in FIG. 11. In FIGS. 13 and 14 the clamp plate is shown to have a raised outer surface 52 with trunnions 54 and 56 extending from the opposite longitudinal ends. On each side of the central upper raised surface 52 there are flanges 53 with bolt holes 58 and 60. Each of these holes is surrounded by a bead 58*a* and 60*a*. Adjacent each of the bolt holes 58 and 60 are weld holes 62, 64, 66 and 68. When the two plates are assembled into the plate assembly 36 as shown in FIG. 11, the holes 62–68 are not in alignment. Rather, the weld holes are simply a vehicle for weld material which will assist in securing the two plates together. Bolts 68 and 70 will pass through the aligned bolt holes 58 and 60, as particularly shown in FIG. 12, which will secure the plates in overlapping position, with the longitudinal direction of the trunnions forming an angle of approximately 60° or thereabout. When the plates are so positioned, the holes 62–68 will be filled with weld and there will be additional arcuate welds, indicated at 72 and 74 along the arcuate surfaces 61 and 63 of the plate flanges, the welds being indicated particularly in FIG. 11. Further, each of the plate trunnions 54 and 56, in addition to supporting the ends of the cross brace tubes, will provide a gap which will be filled with weld material as indicated at 76 in FIG. 11. The tubes are thus welded at their opposite ends to the trunnions on the center clamp plate assembly and to the end blocks. The two halves of the center plate assembly will be bolted together and welded together both at the spot holes and along the adjoining and facing arcuate surfaces to form the welds 72 and 74.

Figure 12:
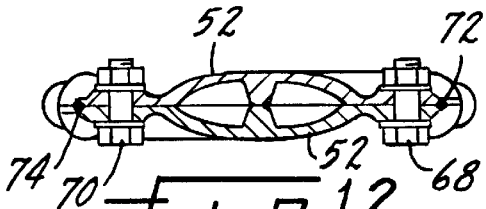
FIG. 12 is a section along plane 12—12 of FIG. 11.

FIG. 14 shows the inner or facing side of each of the center clamp plates. There is a longitudinally extending central projection 82, which as particularly shown in FIG. 14, extends from opposite ends of the plate through a center recess 84. The projections 82 will cross in an area of reduced height 80 as shown in FIG. 12 and in FIG. 16.

It should be noted that the side flanges of the plates 38 and 40 have what may be termed blended surfaces which results in the elimination of stress concentrations found in prior plate assemblies. The size of the bolt holes 58 and 60 and the radiused flanges of the plates allow the angle between braces to be altered by +/−5°. This is advantageous in allowing for ease in designing braces for application to trucks that are not AAR standard. The use of trunnions at each end of the end blocks and on the center clamp assembly eliminates two tube forming operations which were necessary in prior designs and further allow ease of assembly and manufacturing of the entire cross brace truck. A result of the improved center clamp assembly, end blocks and struts is that all tube forming operations have been eliminated which allows the use of a much higher strength material for the struts. Previously, the necessity of deforming the struts limited the design strength of the tubes.

Whereas the preferred form of the invention has been shown and described herein, it should be realized that there may be many modifications, substitutions and alterations thereto.

What is claimed is:

1. A rail car truck comprising a pair of longitudinally spaced wheelsets, a pair of laterally spaced side frames extending between and supported by said wheelsets, a bolster extending between said side frames to support a vehicle body, and a brace connected between said side frames to control relative longitudinal movement therebetween, said brace including a center clamp assembly located generally intermediate said side frames and generally mid-way between said wheelsets, each side frame mounting a pair of longitudinally spaced end blocks, and four struts, each strut being inclined to the longitudinal axis of the truck and extending from and being connected to an end block and to the center clamp assembly, said center clamp assembly including four outwardly-directed trunnions, each extending into one of said struts, said center clamp assembly forming a load transmitting connection between the four struts connected thereto.

2. The rail car truck of claim 1 wherein each end block end block has an outwardly extending trunnion extending into its associated strut.

3. The rail car truck of claim 1 wherein each end block is welded to its associated strut.

4. The rail car truck of claim 1 wherein each of said rail car struts is welded to the center clamp assembly at said trunnions.

5. The rail car truck of claim 1 wherein each of said struts is a hollow tube of constant diameter.

6. The rail car truck of claim 1 wherein said center clamp assembly includes a pair of clamp plates fastened together, generally intermediate their ends, with each clamp plate end having a trunnion fastened to one of said struts.

7. The rail car truck of claim 6 wherein said clamp plates are identical, each having an exposed surface and a facing surface, with the facing surfaces being in contact when the clamp plates are assembled.

8. The rail car truck of claim 7 wherein each of said clamp plates has a length greater than its width, with one of said trunnions extending outwardly from the opposite longitudinal ends of each clamp plate.

9. The rail car truck of claim 8 wherein each of said clamp plates are fastened together generally at their mid-point by a pair of bolts extending through a clamp plate generally along the width thereof.

10. The rail car truck of claim 9 further including a plurality of weld holes in each clamp plate to provide location for welds for attaching said clamp plates one to another.

11. The rail car truck of claim 10 wherein each of said clamp plates have arcuate edges, generally at the mid-point thereof, with the arcuate edges of the clamp plates being welded together along the length thereof.

12. The rail car truck of claim 7 wherein each of said clamp plates, along the facing surface thereof, has a longitudinally extending rib.

13. The rail car truck of claim 12 wherein each of said clamp plate facing surfaces have a longitudinal recess, each rib being located in a recess.

* * * * *